US009689343B2

(12) United States Patent
Ullrich

(10) Patent No.: US 9,689,343 B2
(45) Date of Patent: Jun. 27, 2017

(54) PISTON

(71) Applicant: Mahle International GmbH, Stuttgart (DE)

(72) Inventor: Michael Ullrich, Moeglingen (DE)

(73) Assignee: Mahle International GmbH (DE)

( * ) Notice: Subject to any disclaimer, the term of this patent is extended or adjusted under 35 U.S.C. 154(b) by 179 days.

(21) Appl. No.: 14/418,435

(22) PCT Filed: Jul. 31, 2013

(86) PCT No.: PCT/EP2013/066092
§ 371 (c)(1),
(2) Date: Jan. 29, 2015

(87) PCT Pub. No.: WO2014/020066
PCT Pub. Date: Feb. 6, 2014

(65) Prior Publication Data

US 2015/0167584 A1 Jun. 18, 2015

(30) Foreign Application Priority Data

Aug. 1, 2012 (DE) ..... 10 2012 213 558

(51) Int. Cl.
*F02F 3/00* (2006.01)
*F02F 3/20* (2006.01)
*F02F 3/22* (2006.01)

(52) U.S. Cl.
CPC . *F02F 3/20* (2013.01); *F02F 3/22* (2013.01)

(58) Field of Classification Search
CPC ..... F02F 3/22; F02F 3/003; F01P 3/10; F16J 1/09
(Continued)

(56) References Cited

U.S. PATENT DOCUMENTS 5,595,145 A * 1/1997 Ozawa ..... F02F 3/22 123/41.35
5,771,776 A 6/1998 Itoh
(Continued)

FOREIGN PATENT DOCUMENTS

DE 3991677 T1 6/1991
DE 19716702 A1 11/1997
(Continued)

OTHER PUBLICATIONS

English abstract for DE—102006056013.
(Continued)

*Primary Examiner* — Marguerite McMahon
*Assistant Examiner* — James Kim
(74) *Attorney, Agent, or Firm* — Fishman Stewart PLLC

(57) ABSTRACT

A piston for an internal combustion engine may include an at least partially extending circumferential cooling duct for circulating a coolant. The coolant duct may be closed by a cooling duct cover apart from an inlet opening and an outlet opening. The inlet opening and the outlet opening may be arranged in the cooling duct cover. A guide element may be disposed in a region of the inlet opening configured to catch an incident coolant jet. The guide element may guide the coolant jet into the cooling duct and deflect the coolant jet in precisely a circumferential direction along the cooling duct.

20 Claims, 1 Drawing Sheet

(58) Field of Classification Search
USPC ..... 123/193.6, 41.35
See application file for complete search history.

(56) References Cited

U.S. PATENT DOCUMENTS

| | | | | |
|---|---|---|---|---|
| 6,401,595 | B1 * | 6/2002 | Bochart | F02F 3/00 92/186 |
| 6,647,861 | B1 * | 11/2003 | Jacobi | F02F 3/22 92/186 |
| 6,659,062 | B1 * | 12/2003 | Issler | F02F 3/22 123/193.6 |
| 8,065,984 | B2 | 11/2011 | Issler et al. | |
| 8,079,403 | B2 | 12/2011 | Kollotzek | |
| 8,511,261 | B2 * | 8/2013 | Maruyama | F02F 3/22 123/41.35 |
| 2002/0178910 | A1 | 12/2002 | Keller et al. | |
| 2008/0121204 | A1 * | 5/2008 | Scharp | F02F 3/22 123/193.6 |
| 2009/0194059 | A1 * | 8/2009 | Grahle | F02F 3/003 123/193.6 |
| 2010/0163203 | A1 | 7/2010 | Kollotzek | |
| 2011/0174245 | A1 * | 7/2011 | Kollotzek | F02F 3/22 123/41.39 |
| 2014/0130767 | A1 | 5/2014 | Leitl | |

FOREIGN PATENT DOCUMENTS

| | | | | |
|---|---|---|---|---|
| DE | 19926567 | A1 | | 12/2000 |
| DE | 102006013884 | A1 | | 9/2007 |
| DE | 102006056013 | A1 | | 5/2008 |
| DE | 102007044105 | A1 | | 10/2008 |
| DE | 102008020231 | A1 | | 10/2009 |
| DE | 102008038324 | A1 | | 2/2010 |
| DE | 102009056922 | A1 | | 6/2011 |
| DE | 102010012119 | A1 | | 9/2011 |
| DE | 102011106379 | A1 | | 1/2013 |
| EP | 1238191 | A1 | | 9/2002 |
| JP | 59-27119 | | | 2/1984 |
| JP | 5927119 | U | * | 2/1984 |
| JP | 2006-090159 | A | | 4/2006 |
| JP | 2008-240609 | A | | 10/2008 |

OTHER PUBLICATIONS

English abstract for DE—102010013119.
English abstract for JP—2006-90159.
English abstract for DE—102009056922.
English abstract for JP2008-240609.

* cited by examiner

PISTON

CROSS-REFERENCE TO RELATED APPLICATIONS

This application claims priority to German Patent Application No. 10 2012 213 558.8, filed Aug. 1, 2012, and International Patent Application No. PCT/EP2013/066092, filed Jul. 31, 2013, both of which are hereby incorporated by reference in their entirety.

TECHNICAL FIELD

The present invention relates to a piston of an internal combustion engine having a circumferential cooling duct according to the introductory clause of claim 1. The invention furthermore relates to a cooling duct cover made of sheet metal for a cooling duct of such a piston, and an internal combustion engine with at least one such piston.

BACKGROUND

Generic pistons are sufficiently known and are produced for example as cast or respectively as forged pistons. A covering of the cooling duct of such a piston, which is initially open on one side, usually takes place by means of a cooling duct cover in the manner of a metal sheet. The metal sheet itself already has here at least one inlet opening and an outlet opening, which are usually arranged adjacent to one another, so that there are almost 360° between the inlet opening and the outlet opening.

From DE 10 2008 038 324 A1 a piston is known having a cooling duct formed through a foundry core, which cooling duct has two inlet openings arranged adjacent to one another and two opposite outlet openings, separated from one another by a throttle. A cooling oil jet, incident obliquely to the piston axis, enters in the upper and lower dead centre through respectively one of the two inlet openings into the cooling duct.

From DE 10 2006 013 884 A1 a further piston is known for an internal combustion engine with a piston head and with a piston crown exposed to at least one combustion jet and with a piston skirt. The piston head and the piston skirt include here a circumferential outer cooling duct, wherein in the latter an annular dividing wall is provided, arranged parallel to the piston crown, which dividing wall has one or more nozzle-like openings which are arranged such that their respective outlet jet is directed parallel to the piston axis towards the underside of the piston crown. Hereby, the cooling effect of the cooling oil, supplied to the cooling duct, is to be improved.

From DE 10 2008 020 231 A1 a cast piston is known, which has a cooling duct formed through a foundry core. This cast cooling duct has an oil feed opening, which is arranged perpendicularly to the direction of the cooling duct and which has a funnel-shaped inlet to receive an oil jet directed parallel to the piston axis.

From EP 1 238 191 B1 a further generic piston is known, wherein in the region of an inlet opening a tube-like feed is fastened to the cooling duct cover by a snap-on connection or by clipping in.

SUMMARY

The present invention is concerned with the problem of indicating an improved embodiment for a piston of the generic type, which is distinguished in particular by an improved cooling effect.

This problem is solved according to the invention by the subjects of the independent claims. Advantageous embodiments are the subject of the dependent claims.

The present invention is based on the general idea, in a piston known per se with a cooling duct cover covering a cooling duct, to provide on this cooling duct cover both an inlet opening and an outlet opening and to arrange in the region of the inlet opening a guide element on the cooling duct cover, which guides an incident coolant jet in a funnel-shaped manner into the cooling duct and thereby catches the cooling duct jet and, at the same time, deflects the introduced coolant jet in precisely a circumferential direction of the piston, that is to say therefore in a flow direction of the cooling duct. Through the funnel-like configuration of the inlet opening, it is possible to introduce coolant, i.e. cooling oil, preferably independently of the position of the piston, also into the cooling duct when it is injected in an oil jet aligned obliquely to the piston axis, whereby the degree of catching is increased and more coolant flows through the cooling duct and the latter is therefore better cooled. Through the conically widening inlet opening, it is possible in particular to catch the coolant, injected from a coolant nozzle, in the upper dead centre, in the lower dead centre and also in all intermediate positions and to deflect it directly into the cooling duct. In the case of inlet openings hitherto, in particular round inlet openings, it was not possible to catch the coolant jet, injected by a coolant nozzle, in all positions of the piston, in particular both in the upper and also in the lower dead centre, and to thereby use it for the cooling. Depending on the configuration of the guide element provided according to the invention, not only is an axial injecting of the coolant into the inlet opening possible here, but also an oblique injecting, wherein with an upper dead centre the injected coolant jet strikes one side of the guide element, whereas in the lower dead centre it strikes the opposite side of the funnel-like guide element and in both points deflects the arriving coolant jet into the coolant duct. It is thereby also possible that with a shared so-called Y-coolant nozzle the two pistons in respectively two adjacent cylinders are supplied with coolant simultaneously from the centre, i.e. are injected with coolant. Here, despite an injecting which is not parallel to the piston axis, a high degree of catching can be achieved and the structure of the internal combustion engine, in particular its oil circuit, can be simplified by the omission of several lines etc.

In an advantageous further development of the solution according to the invention, the guide element is constructed in the manner of a nozzle, a funnel, a connecting piece or a deflector. The list already suggests how varied the embodiment possibilities of the guide element according to the invention are, wherein all embodiments have in common the fact that the guide element is able to introduce almost 100% of the coolant, injected by the coolant nozzle, into the cooling duct and thereby use it for cooling.

Expediently, the inlet opening is arranged adjacent to the outlet opening and is separated by a separating plate. The adjacent arrangement of the inlet opening and the outlet opening entails a cooling duct which runs around almost 360° in the piston and thereby achieves an optimum cooling effect. Between the inlet opening and the outlet opening, a separating plate or a throttle can be provided here, which prevents a direct flowing off of the coolant, injected into the inlet opening, on the short path in the direction of the outlet opening, without previously flowing through the cooling duct. Through the configuration of the guide element according to the invention, however, this is in any case already prevented because the guide element deflects the incident coolant jet in precisely one flow direction, i.e. in through-flow direction on the long path into the cooling duct and thereby prevents an immediate emergence of the coolant at the adjacent outlet opening.

Expediently, the guide element and/or the separating plate form an integral component of the cooling duct cover. In order to have to use as few working steps as possible for the production and in particular for the installation of the piston according to the invention, the guide element can also already form an integral component of the cooling duct cover, so that it is conceivable, for example, that the cooling duct cover is produced in a single stamping/deforming working step together with the guide element and/or with the separating plate. Of course, a separate production of the guide element or respectively of the separating plate is also conceivable, wherein then the guide element must be connected with the cooling duct cover in the region of the inlet opening in a later working step.

In an advantageous further development of the solution according to the invention, the inlet opening has an elongated or oval shape. Through such an oval shape, the region in which the coolant jet, injected by the coolant nozzle, strikes in the course of the piston stroke can be enlarged, whereby more coolant can be caught and used for cooling the piston. An orientation of the ovality or generally the longest extent of a differently shaped inlet opening extends here preferably substantially in circumferential direction of the piston. Thereby, an inlet opening can be provided which is longer than the cooling duct is wide. This makes it possible to always direct the oil jet into the cooling duct preferably over the entire piston stroke. An obliquely injecting oil nozzle can be arranged here so that the striking point of the oil jet preferably lies approximately in the centre of the cooling duct and travels during the movements of the piston in the duct- or respectively tangential direction to and fro. Expediently, the piston is constructed as a cast light metal piston with a milled cooling duct or as a forged steel piston. In a preferred embodiment, the piston needs to have only a preferably fully circumferential open cooling duct with a constant cross-section, on which the cooling duct cover according to the invention is mounted in one step. In particular, such a piston can also be constructed as a so-called monotherm piston and consist completely of forged steel. In monotherm pistons, the piston skirt is connected securely with the hub bore and the piston head, and the cooling duct is closed by a cooling duct cover, in particular by a spring metal sheet, on the underside.

Further important features and advantages of the invention will emerge from the subclaims, from the drawings and from the associated figure description with the aid of the drawings.

It shall be understood that the features mentioned above and to be further explained below are able to be used not only in the respectively indicated combination, but also in other combinations or in isolation, without departing from the scope of the present invention.

Preferred example embodiments of the invention are illustrated in the drawings and are explained in further detail in the following description, wherein the same reference numbers refer to identical or similar or functionally identical components.

BRIEF DESCRIPTION OF THE DRAWINGS

There are shown, respectively diagrammatically,

FIG. 1), FIG. 3 a sectional illustration through the cooling duct of the piston in the region of the inlet- and outlet opening.

DETAILED DESCRIPTION

Figure 1:
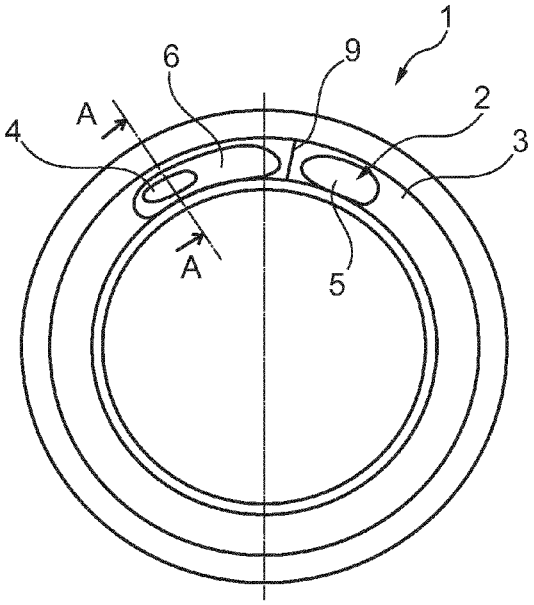
FIG. 1 a bottom view onto a piston according to the invention with a cooling duct cover covering a cooling duct, FIG. 2 a sectional illustration through the piston according to the invention, along the section plane A-A (cf.
Figure 2:
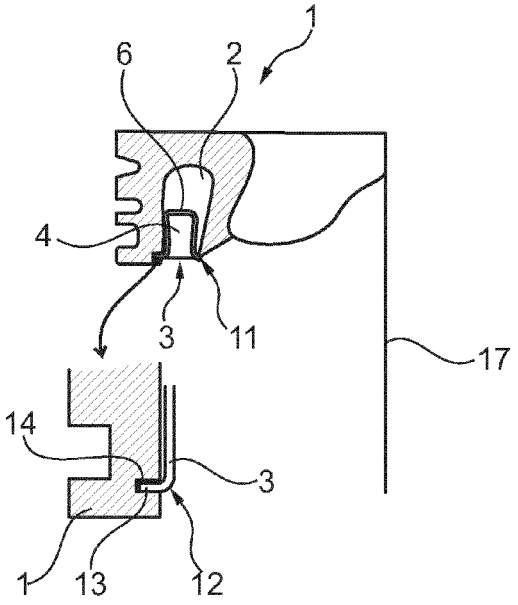
Figure 3:
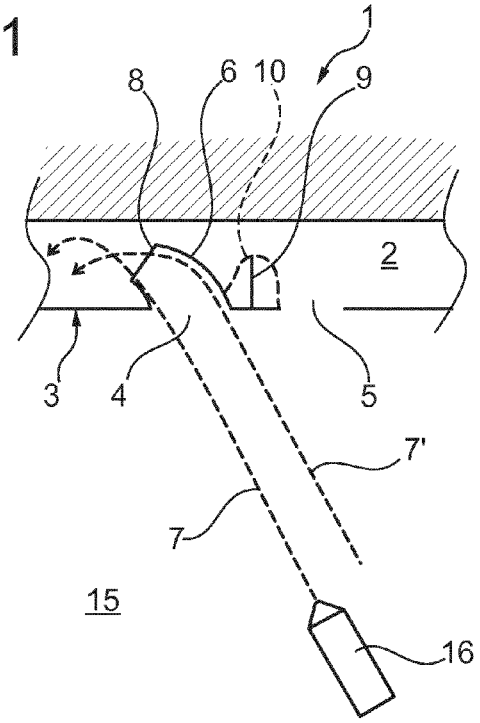

According to FIGS. 1 to 3, a piston 1, according to the invention, of an internal combustion engine 15 (cf. FIG. 3) has a cooling duct 2 for cooling the piston 1 during the operation of the internal combustion engine 15, wherein the cooling duct 2 is closed by a cooling duct cover 3 apart from an inlet opening 4 and an outlet opening 5. According to the invention, the inlet opening 4 and the outlet opening 5 are formed here through the cooling duct cover 3, wherein at the same time a guide element 6 is provided in the region of the inlet opening 4, which guide element catches an incident coolant jet 7,7' (cf. FIG. 3) in the manner of a funnel and guides it into the cooling duct 2 and in addition deflects it in circumferential direction of the piston 1, that is to say in the direction of the cooling duct 2. As can be seen from FIG. 1 here, the inlet opening 4 has an oval shape. The outlet opening 5 can also be constructed in the same or a similar manner.

Looking further at FIG. 1, it can be seen that the inlet opening 4 and the outlet opening 5 of the cooling duct 2 are arranged adjacent to one another, whereby the cooling duct 2 runs around through almost 360°. The coolant which is injected via the inlet opening 4, for example cooling oil, must therefore first run through the entire cooling duct 2 and in so doing can cool the piston 1, before it emerges therefrom again via the outlet opening 5. Between the inlet opening 4 and the outlet opening 5 in addition a separating plate 9 or a throttle 10 can be arranged (the latter is illustrated in FIG. 3 by a broken line), whereby an undesired bypass flow directly from the inlet opening 4 to the outlet opening 5 without previous flowing through the cooling duct 2 can be reliably prevented. Of course, the solution according to the invention also functions without such a separating plate 9 or respectively without such a throttle 10, because as illustrated in FIG. 3 the guide element 6 points with its spout 8 away from the separating plate 9 or respectively from the throttle 10 and thereby enforces a coolant flow flowing through the entire cooling duct 2.

The guide element 6 can be constructed in the manner of a nozzle, a funnel, a connecting piece or a deflector, wherein all embodiments have in common the funnel-like catching of the coolant jet 7, 7'. For the funnel-like catching of the coolant jet 7, 7' and for its deflection in longitudinal direction of the cooling duct 2, the guide element 6 has a spout 8, for example similar to an outlet on a teapot.

The guide element 6, the separating plate 9 or respectively the throttle 10 can form an integral component of the cooling duct cover 3, that is to say can be constructed in one piece therewith. This offers the particular advantage that the piston 1 can be produced in a conventional manner and both the inlet opening 4 and also the outlet opening 5 or respectively the separating plate 9 or the throttle 10 and the guide element 6 can be already prefabricated by a shared working step. A production of such a cooling duct cover 3 can take place for example by a stamping/deforming process, wherein in this case the cooling duct cover 3 is stamped for example from a metal sheet and is subsequently deformed. Hereby, the cooling duct cover 3 can be produced in a cost-efficient manner. Of course, a constructed cooling duct cover 3 is also conceivable, in which the guide element 6 and/or the separating plate 9 and/or the throttle 10 are connected with the cooling duct cover 3 in a separate working step.

The piston 1 can generally be constructed as a cast light metal piston, for example as an aluminium piston, with a milled cooling duct 2, or as a forged steel piston. A connection of the cooling duct cover 3 with the piston 1 can take place for example by way of a welded connection 11 and/or by way of a snap-on connection 12 (cf. FIG. 2). The welded connection 11 is preferably welded by laser, wherein for the production of the snap-on connection 12 an edge 13 of the cooling duct cover 3 is bent around, so that it can engage into a corresponding recess 14 on the piston 1 (cf. FIG. 2).

Of course, it is also conceivable to produce the cooling duct cover 3 according to the invention separately and to market it separately, so that in this application protection is also claimed solely for such a cooling duct cover 3.

Looking at FIG. 3, it can be seen that the internal combustion engine 15 has at least one coolant nozzle 16 for injecting coolant into the piston 1, wherein this coolant nozzle 16, in the case which is drawn, is aligned obliquely to the piston axis 17. The guide element 6 is constructed here such that it catches the coolant, injected by the coolant nozzle 16, both in the upper dead centre, which in the present case corresponds to the coolant jet 7, and also in the lower dead centre of the piston 1, which in the present case corresponds to the coolant jet 7', and deflects it into the cooling duct 2. Of course, all coolant jets lying between the upper dead centre and the lower dead centre and not drawn in further detail are caught and can be deflected by the guide element 6. The coolant nozzle 16 does not necessarily have to be aligned obliquely to the piston axis 17 here, as in the case which is drawn, but rather it can generally also be aligned parallel thereto, wherein of course also further embodiments of the coolant nozzle 16 are conceivable, thus for example a Y-nozzle, by means of which two pistons 1 arranged adjacent to one another can be acted upon simultaneously by a coolant jet 7, 7' and thereby cooled. Looking at FIG. 3, it can be seen that in all piston positions the coolant jet 7, 7' is caught by the guide element 6 and deflected in the cooling duct 2, whereby a particularly effective cooling of the piston 1 can be achieved. With the cooling duct cover 3 according to the invention, and with the associated piston 1 according to the invention, therefore an extremely effective cooling of the piston 1 and hence an extremely effective operation of the internal combustion engine 15 is possible.

The invention claimed is:

1. A piston for an internal combustion engine, comprising:

cooling duct extending at least partially in a circumferential direction about a piston axis for circulating a coolant;

a circumferentially extending cooling duct cover closing the cooling duct, the cooling duct cover including an inlet opening and an outlet opening; and a guide element disposed at the inlet opening configured to catch an incident coolant jet, wherein the guide element guides the coolant jet into the cooling duct and deflects the coolant jet in a circumferential direction along the cooling duct;

wherein the inlet opening is arranged in a region of the cooling duct cover adjacent to the outlet opening.

2. The piston according to claim 1, wherein the guide element includes at least one of a nozzle, a funnel, a connecting piece and a deflector.

3. The piston according to claim 1, further comprising a separating structure disposed in the region of the cooling duct cover and projecting axially into the cooling duct with respect to the piston axis;

wherein the separating structure is arranged adjacent to the inlet opening on one side and adjacent to the outlet opening on another side opposite thereof.

4. The piston according to claim 3, wherein at least one of the guide element and the separating structure is integral with the cooling duct cover.

5. The piston according to claim 1, wherein the inlet opening defines at least one of an elongated shape and an oval shape.

6. The piston according to claim 1, wherein the piston is formed as at least one of a cast light metal piston with a milled cooling duct and a forged steel piston.

7. The piston according to claim 1, wherein the cooling duct cover is connected via at least one of a welded connection and a snap-on connection.

8. A cooling duct cover, comprising:

a circumferential member for covering a cooling duct of a piston, the circumferential member extending circumferentially about an axis including an inlet opening and an outlet opening;

the circumferential member further including a guide element in a region of the inlet opening configured to catch an incident coolant jet; and an axially projecting separating structure disposed on the circumferential member, the separating structure arranged adjacent to the inlet opening on one side and adjacent to the outlet opening on the other side opposite thereof;

wherein the guide element is configured to guide the coolant jet through the inlet opening into the cooling duct and deflect the coolant jet in a circumferential direction of the the axis.

9. The cooling duct cover according to claim 8, wherein the guide element is constructed in one piece with the circumferential member.

10. An internal combustion engine, comprising:

at least one piston including a circumferential cooling duct extending at least partially around the at least one piston for circulating a coolant;

a cooling duct cover enclosing the cooling duct, the cooling duct cover including an inlet opening defining an elongated shape and an outlet opening, wherein at least one of a separating plate and a throttle is arranged between the inlet opening and the outlet opening;

a guide element arranged in a region of the inlet opening configured to guide the coolant into the cooling duct, the guide element having a spout disposed in the cooling duct and pointing in a direction away from the at least one of the separating plate and the throttle; and a coolant nozzle for injecting the coolant into the cooling duct, the coolant nozzle being positioned obliquely to a piston axis;

wherein the guide element is configured to catch the coolant in an upper dead centre position of the piston, a lower dead centre position of the piston and a plurality of intermediate positions between the upper dead centre position and the lower dead centre position, wherein the guide element deflects the coolant in precisely a circumferential direction into the cooling duct; and wherein the separating plate is provided adjacent to the inlet opening on one side and adjacent to the outlet opening on the other side opposite thereof.

11. The internal combustion engine according to claim 10, wherein the guide element is configured as at least one of a nozzle, a funnel, a connecting piece and a deflector.

12. The internal combustion engine according to claim 10, wherein the cooling duct cover includes a peripheral edge that engages into a corresponding recess in the cooling duct to form a snap-on connection.

13. The cooling duct cover according to claim 8, wherein the inlet opening defines at least one of an elongated shape and an oval shape.

14. The cooling duct cover according to claim 8, wherein the separating structure includes a separating plate.

15. The cooling duct cover according to claim 8, wherein the guide element includes at least one of a nozzle, a funnel, a connecting piece and a deflector.

16. The piston according to claim 1, wherein the guide element includes a spout disposed in the cooling duct and pointing in the circumferential direction.

17. The piston according to claim 1, wherein the guide element is configured to catch the coolant in an upper dead centre position, a lower dead centre position, and a plurality of intermediate positions between the upper dead centre position and the lower dead centre position.

18. The piston according to claim 3, wherein the separating structure includes a separating plate.

19. The piston according to claim 3, wherein the separating structure includes a throttle.

20. The cooling duct cover according to claim 8, wherein the separating structure includes a throttle.

* * * * *